United States Patent [19]

Granger

[11] 3,933,329

[45] Jan. 20, 1976

[54] SUPPORT APPARATUS FOR A PORTABLE SHOWER HEAD

[76] Inventor: Maurice Granger, 28 rue Charles de Gaulle, 42000 Saint Etienne - Loire, France

[22] Filed: Jan. 10, 1974

[21] Appl. No.: 432,338

[52] U.S. Cl. ..... 248/295; 188/65.1

[51] Int. Cl.[2] ..... A47F 5/00; A47H 1/10

[58] Field of Search ..... 188/65.1, 65.4; 248/123, 248/124, 125, 295–297, 287, 298, 327–329, 248/332, 333, 336–338, 364; 240/68–71

[56] References Cited

UNITED STATES PATENTS

| | | | |
|---|---|---|---|
| 302,468 | 7/1884 | Chase | 240/68 X |
| 730,358 | 6/1903 | Fladby | 248/295 |
| 2,174,828 | 10/1939 | Latocha | 188/65.1 |
| 3,709,453 | 1/1973 | Castigiloni | 248/328 |
| 3,820,752 | 6/1974 | Oram | 248/278 |

FOREIGN PATENTS OR APPLICATIONS

| | | | |
|---|---|---|---|
| 736,111 | 4/1943 | Germany | 188/65.4 |
| 630,476 | 10/1949 | United Kingdom | 248/295 |

*Primary Examiner*—William H. Schultz
*Assistant Examiner*—Lawrence J. Staab
*Attorney, Agent, or Firm*—Haseltine, Lake & Waters

[57] ABSTRACT

Adjustable support apparatus for a portable shower head comprising a fixable vertical guide column on which a carriage is slidable and is provided with a support for a shower head. The carriage is held in place on the guide column by means of a taut cable or an undulating plate which supports a roller secured to the carriage. A control button is supported in the column and is coupled to the cable via a spring and to the plate directly to selectively release the tension in the cable or displace the plate to effect descent of the carriage on the guide column. Upon release of the button the carriage is again held in place on the column.

10 Claims, 10 Drawing Figures

SUPPORT APPARATUS FOR A PORTABLE SHOWER HEAD

FIELD OF THE INVENTION

The invention relates to automatic or semi-automatic manipulating apparatus for the supports of shower heads to permit their vertical displacement.

The invention particularly relates to bathroom accessories and specifically to adjustable bracket supports for portable shower fixtures.

PRIOR ART

The use of portable shower fixtures with flexible water hoses is well known and is becoming exceedingly popular.

It is also known to provide wall mounted brackets on which such shower fixtures can be supported to achieve the same effect as a fixed shower head.

Such brackets can be mounted on a wall above a bathtub, or in a shower stall or the like.

Brackets are known which are fixed and others are known which are adjustable in height either by pulling on the flexible water hose of the portable shower unit to raise the bracket (the bracket being lowered by directly pulling on the shower head itself) or by direct manual action on a carriage supporting the shower unit and slidable on a mounting fixed to the wall.

Wall mountings for a shower unit are also known in which the shower head can be adjusted in height by manually rotating a rotable member at the base of a guide column which cooperates by pulleys and cables with the carriage supporting the shower head.

Although the known arrangements permit regulation of the height of the shower head to correspond to the height of the user, the manipulations involved are extensive and demanding, do not assure a smooth and precise descent of the shower head, and oblige a user in the tub who wishes to use the shower head in hand-held mode for rinsing purposes to awkward physical movements.

SUMMARY OF THE INVENTION

An object of the invention is to provide a support for a portable shower unit in which controlled descent of the shower head can be effected easily either by action on the flexible hose or automatically and instantaneously by direct pushing or pulling action on a control member at the base of a guide column on which the shower head is movable, the stoppage of the shower head being effected by simply terminating said action.

According to a characteristic feature of the invention, the displacement of a carriage for support of the shower unit is controlled by a cable attached to the top of the guide column and passing on a roller or similar means attached to said carriage and the cable is connected via an elastic means applying tension to the cable to a control button such that when the button is actuated the effect of the elastic means is overcome and the cable is slackened and the carriage descends.

According to a further characteristic feature, the roller on the carriage cooperates with undulating impressions stamped in a sheet, which can be separated from the roll, by action on the button to lower the carriage.

DETAILED DESCRIPTION

Figure 1:
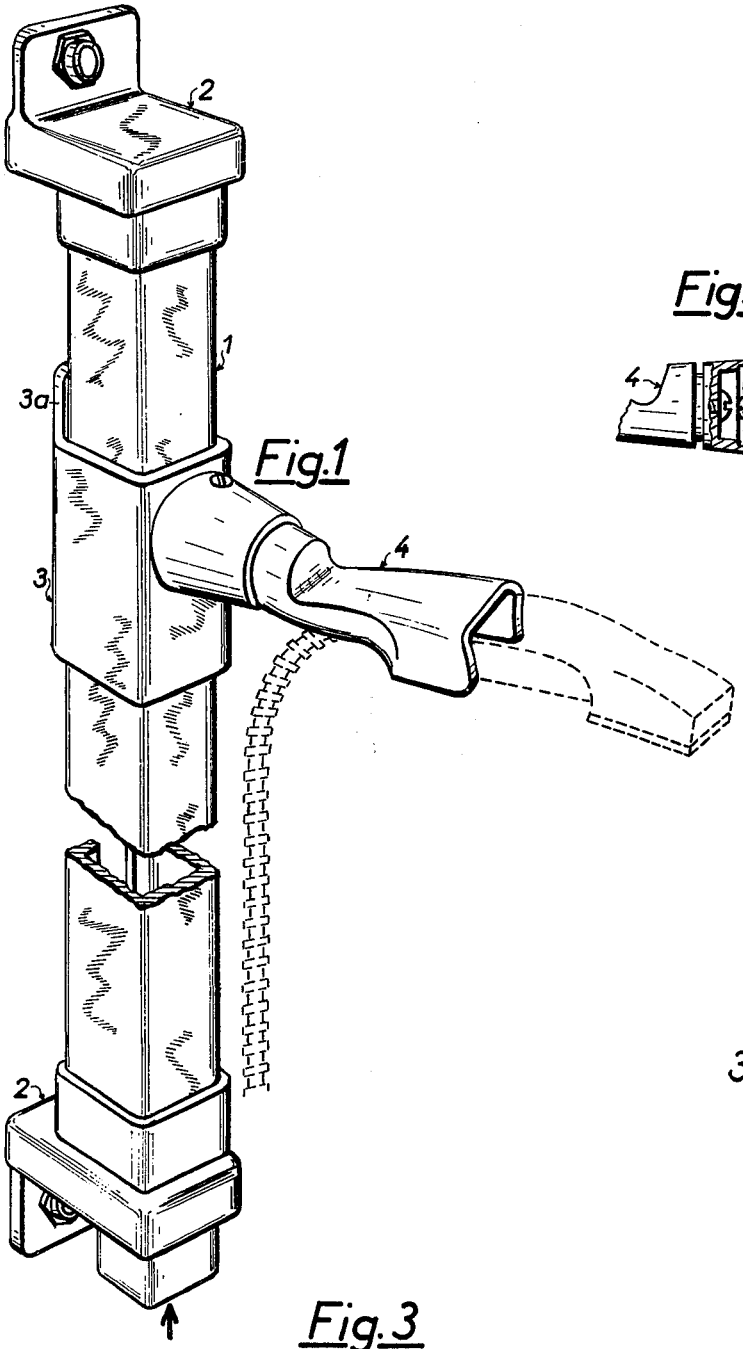
FIG. 1 is a perspective view, broken in length, of one embodiment of the invention.

Referring to the first embodiment of the invention illustrated in FIGS. 1–4, therein is seen a hollow guide column 1 formed from a U-shaped channel member (FIG. 4), the extremities of column 1 being engaged in supports 2 which are capable of being fixed to a wall by any known suitable means. A tubular carriage 3 is slidably mounted on column 1 and the carriage 3 is of suitable size to assure easy sliding on the column without risk of jamming by rocking.

Attached to the carriage 3 in fixed or adjustable fashion is a support 4 adapted for supporting a shower head (shown in dotted outline) to which is connected a flexible water hose (also shown in dotted outline). The shower head can be mounted on the support 4 and directed towards the user for utilization as a fixed shower head and the shower head can also be removed from the support 4 and employed manually as a portable shower head. The support 4 and its cooperation with the shower head and hose unit is well known per se and of itself forms no part of the present invention.

At the opposite side of the column, i.e. the open side thereof, the carriage includes a fixed projecting portion 3*a* which carries a pulley or grooved roller 5 on which is wound a cable 6 which extends the height of the column from its top to a point at its base in the vicinity of a control button 9 thereat.

The cable 6 is attached at its upper end to a bent lug 1*a* of the column in any suitable manner, such as the brake cables of bicycles, i.e. by engagement of enlarged heads 6*a* above a slot 1*b* formed in lug 1*a*. It is possible to provide an adjustment for the point of attachment of the cable.

Figure 2:
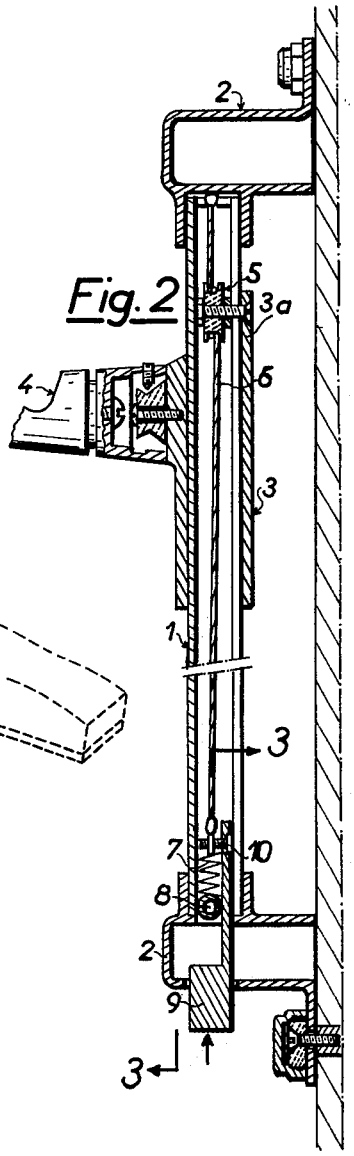
FIG. 2 is a longitudinal sectional view taken through the embodiment of FIG. 1.
Figure 3:
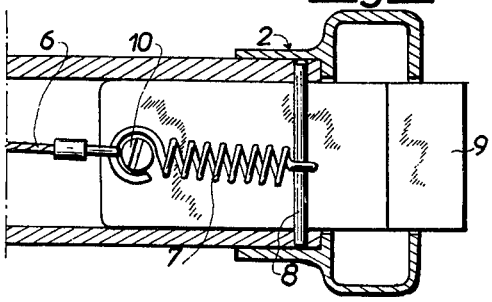
FIG. 3 is a sectional view on enlarged scale taken along line 3—3 in FIG. 2 showing the control button and its relation to the cable.
Figure 4:
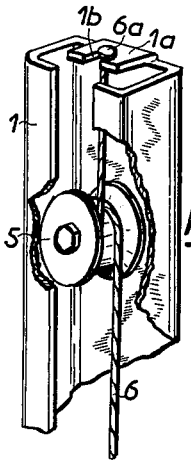
FIG. 4 shows a portion of the embodiment of FIG. 1 broken away to reveal the interior details of the connection of a cable to a fixed roller on the carriage.

At the lower end of the column, the cable is attached to the terminal ring of a tension spring 7 whose opposite end is attached to an axle 8 traversing the interior of the column 1 and fixedly held thereby separately from button 9 which slidably extends through the lower support 2 and is guided for sliding movement in column 1. The engagement between the ring of spring 7 and the button is effected by a screw 10 or the like which serves as well for slidable guidance of the button as seen in FIG. 2.

The cable is tensioned by the spring 7 to effect the support and retention of the carriage 3 on the column 1 and if the control button 9 is pushed, the spring 7 is stretched and the cable 6 is relaxed to allow the carriage 3 to lower by gravity. By releasing the button 9, an instantaneous arrest of the carriage is effected by the tension applied to the cable 6 through the renewed action of the spring 7.

Additionally, it can be seen that by pulling the flexible water hose of the shower unit downwardly, this will impose a downward force on the carriage 3 which will easily travel downwards on column 1 by virtue of the travel of the roller 5 on the taut cable 6. To this effect, the cable 6 and the roller 5 can be selected of suitable materials to facilitate smooth travel of the roller. The descent of the carriage can also be easily effected by directly applying force to the support 4.

Figure 5:
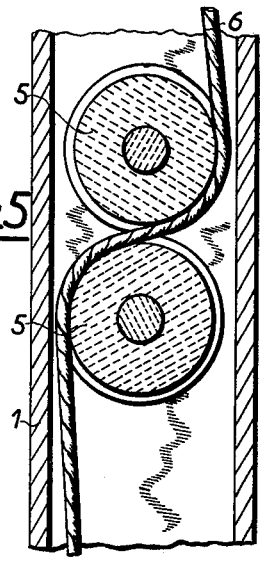
FIGS. 5 and 6 are sectional views showing variations in the connection of the cable to the carriage.
Figure 6:
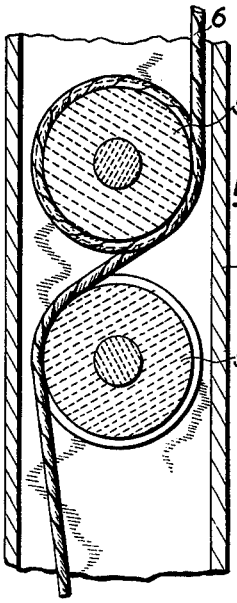

Modifications can be made in the apparatus without departing from the scope of the invention and by way of example, the carriage can carry two rollers 5 one below the other and on which the cable 6 can be simply deflected in S-shape as shown in FIG. 5 or the cable can be wound on the top roller and deflected on the lower roller as shown in FIG. 6. These modifications assure a better tension without sliding if the weight of the support 4 is substantial.

Figure 7:
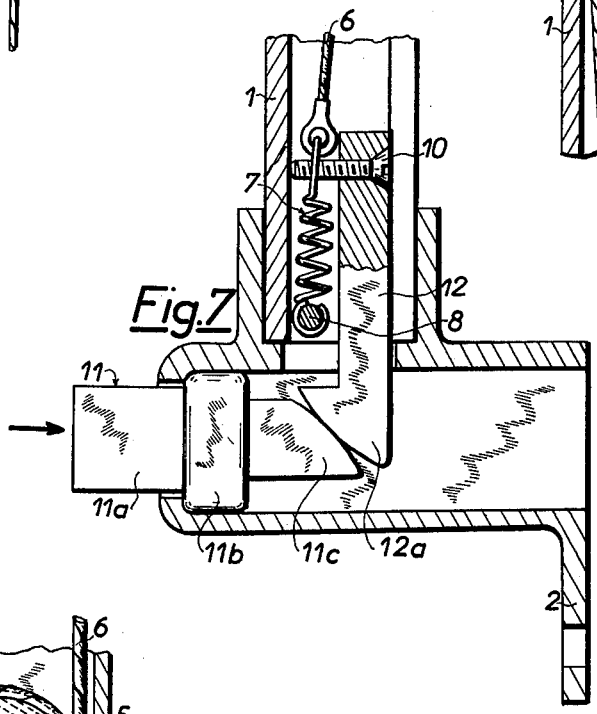
FIG. 7 is a sectional view on enlarged scale showing a modification in the placement of the control button.

The control button can be horizontally disposed as shown at 11 in FIG. 7 to be exposed at the front of the lower support 2. The button 11 includes a front, push portion 11*a*, a central guide portion 11*b* slidably fitted in support 2, and a rear portion 11*c* having an inclined end face engaged with a corresponding face on a portion 12*a* of a finger 12 engaged in column 1 and connected to the spring and thus to the cable 6. The operation of this embodiment is similar to that previously described except that the button 11 is pushed horizontally and transmits its effort through the abutting surfaces to the finger 12 to raise the finger and cancel the effect of the spring 7 and hence permit lowering of the carriage.

Figure 8:
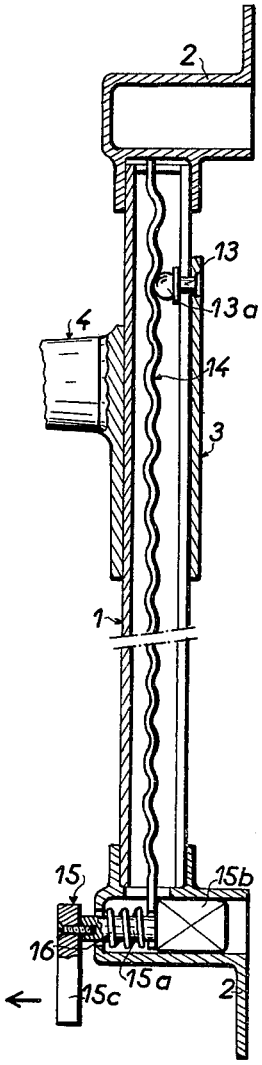
FIG. 8 is a longitudinal sectional view showing a modified embodiment for the automatic descent of the carriage.
Figure 9:
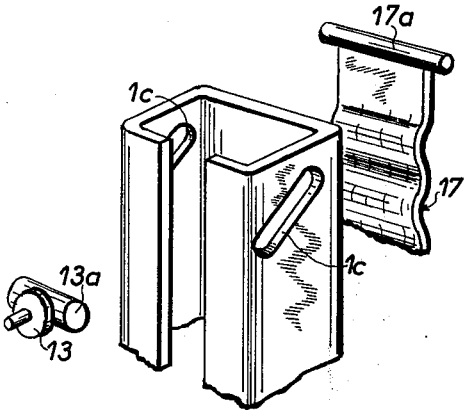
FIG. 9 is an exploded perspective view, broken in length, showing a modified arrangement.
Figure 10:
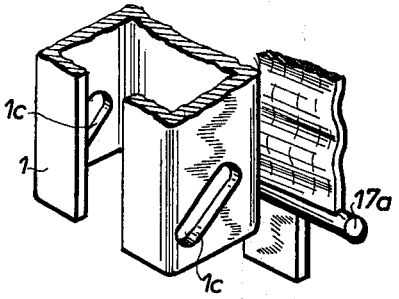
FIG. 10 is a longitudinal sectional view taken through the embodiment of FIG. 9.
Figure 10:
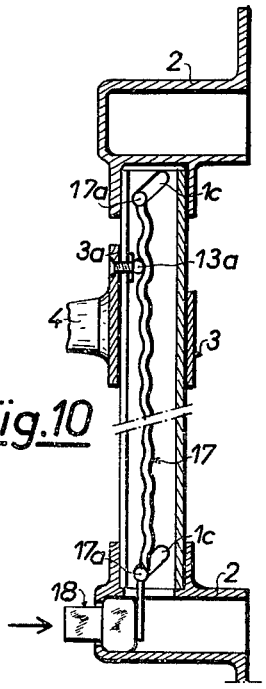

FIGS. 8–10 show a modification according to which the connection between the button and the carriage is no longer effected by a cable and spring, however the descent of the carriage is still achieved by a simple action on the control button.

For example, in FIG. 8 it is seen that the projecting portion 3*a* of carriage 3 carries a fixed member 13 extending through the opening in column 1 and having a roller constituted as a profiled extremity 13*a* such as the cylindrical portion as shown. The profiled portion 13*a* is supported in a hollow portion of complementary shape formed in a sheet 14 extending through the column 1. The sheet can be an undulated band or provided with a multitude of embossings corresponding to the shape of portion 13*a* to effectively retain the carriage in place, and the carriage can be lowered by moving the sheet 14 so that member 13 can ride downwardly on the sheet.

For this purpose, sheet 14 is freely pivotably attached at its upper end to the top of the column and at its lower end, the sheet engages a cylindrical portion 15*a* of button 15. The button has a portion 15*b* which is slidable in support 2 and at the front of the button is a handle 15*c*. A spring 16 acts between the button and the support 2 to return the button to its initial position after it has been displaced and has allowed the carriage to descend the desired amount.

Furthermore, in this case to keep the opening of the column hidden, that is facing the wall, the arrangement of the member 13 and the sheet 14 requires a pulling action on the handle of the button to move the sheet 14 from member 13. Of course, it is equally possible to reverse the arrangement by placing the opening in the column towards the front and effecting lowering of the carriage by pushing the button, thereby eliminating the handle 15*c*.

In FIGS. 9 and 10 there is shown a variation in the movement of the undulated sheet 14 with respect to member 13. In this embodiment, the opening of the column 1s placed at the front and the member 13 is carried by the carriage to ride in this opening at the front of the sheet 17 such that release of the carriage for descent is effected by pushing button 18 slidably mounted in support 2.

The displacement of the sheet 17 is effected by the/sliding of pins 17*a* fixed to sheet 17 in oblique slots 17*c* formed in the side walls of the column 1.

It is to be understood that the weight of the sheet is sufficient to cause return of pins 17*a* to the lower ends of the slots 17*c*, after release of the button, whereupon the sheet reengages the member 13. The button 18 itself can be internally spring-loaded to return to initial position when it is no longer pushed.

The advantages of the invention are believed to be apparent from the description of the embodiments thereof. However, it is to be underlined that the functioning of the apparatus is particularly easy especially the capability of effecting instantaneous descent of the carriage for the support of the shower head from the base of the column, i.e. from a tub without involved physical movements.

In order to raise the carriage and the support for the shower head, it is only necessary to apply upward pressure on the carriage 3 or the support 4 to raise the same to the desired level.

The invention is not limited to the particular disclosed embodiments, but rather includes all modifications and variations within its scope as defined in the appended claims.

What is claimed is:

1. Adjustable support apparatus for a portable shower head, said apparatus comprising a fixable vertical guide column having a front and rear, a carriage vertically slidable on said guide column and including a support for a shower head, releasable means supporting said carriage on said guide column, and a linearly displaceable control means supported by said column and coupled to said releasable means to selectively release the same in one direction of displacement of the control means and permit descent of the carriage on the guide column and to re-effect support of the carriage by the releasable means upon release of the control means, said releasable means comprising a cable extending along said column, said cable having a given length with one end fixed to said column, at least one roller attached to said carriage and on which said cable passes, and a spring connected to said column and to said cable at the other end thereof to render the cable taut and hold the carriage in place on the column, said control means including means to oppose the action of the spring to slacken the cable when the control means is displaced in said one direction and allow the roller to travel by gravity downwards along the cable whereby the carriage descends.

2. Apparatus as claimed in claim 1 wherein said means to oppose the action of said spring includes a displaceable button coupled to said spring for opposing the action thereof on the cable.

3. Apparatus as claimed in claim 1 wherein said control means comprises a displaceable button disposed horizontally at the front of said guide column at the lower end thereof.

4. Apparatus as claimed in claim 1 wherein said control means comprises a displaceable button disposed horizontally at the front of said guide column at the lower end thereof and a displaceable finger connected to said spring and acted on by said button.

5. Apparatus as claimed in claim 1 wherein said means to oppose the action of the spring comprises a displaceable button disposed vertically in prolongation of said column at the bottom thereof and directly connected to said spring.

6. Apparatus as claimed in claim 1 wherein two of said rollers are mounted on said carriage one above the other, said cable being wound around the upper roller and being deflected on the lower roller in S shape.

7. Apparatus as claimed in claim 1 wherein two of said rollers are mounted on said carriage one above the other, said cable passing on said rollers and being deflected thereby.

8. Apparatus as claimed in claim 5 wherein said button includes a guide screw in said column to which said spring is secured at one end thereof, said one end of the spring being connected to said other end of the cable, and an axle fixed in said column to which the opposite end of the spring is secured.

9. Apparatus as claimed in claim 1 wherein said guide column is hollow and has a vertical opening extending therealong at the rear of said guide column, said roller extending through said column, said cable extending within said column, said control means comprising a displaceable button which is pushed to slacken said cable.

10. Apparatus as claimed in claim 1 wherein said guide column is hollow and encloses said cable, said guide column having a prismatic external shape, said carriage being hollow and having an inner surface of prismatic shape corresponding to that of said guide column.

* * * * *